United States Patent [19]

Musgrave

[11] 4,391,075

[45] Jul. 5, 1983

[54] INSULATED ROOF STRUCTURE

[75] Inventor: Dwight S. Musgrave, Granville, Ohio

[73] Assignee: Owens-Corning Fiberglas Corporation, Toledo, Ohio

[21] Appl. No.: 202,989

[22] Filed: Nov. 3, 1980

[51] Int. Cl.[3] ..... E04B 1/74; E04B 5/57

[52] U.S. Cl. ..... 52/404; 52/484; 52/486

[58] Field of Search ..... 52/404, 406, 407, 90, 52/93, 712–714, 483, 484, 486, 408

[56] References Cited

U.S. PATENT DOCUMENTS

| | | | |
|---|---|---|---|
| 1,638,671 | 8/1927 | Wagner | 52/713 |
| 3,791,089 | 2/1974 | Alderman | 52/484 |
| 4,044,521 | 8/1977 | Fischer et al. | 52/483 |

FOREIGN PATENT DOCUMENTS

| | | | |
|---|---|---|---|
| 1075111 | 4/1954 | France | 52/93 |

*Primary Examiner*—James L. Ridgill, Jr.

*Attorney, Agent, or Firm*—Ronald C. Hudgens; Philip R. Cloutier; Paul J. Rose

[57] ABSTRACT

The roof structure includes main support beams (18), auxiliary cross beams (12), hangers (20) with stub axles (32*a*) mounted on the cross beams (12), rollers (22) extending parallel to the cross beams (12) and each rotatably mounted on stub axles (32*a*) of adjacent hangers (20), insulation strips (36) strung over rollers (22) on successive cross beams (12), roof panels (14) forming a cover over the main support beams (18) and cross beams (12), and batts (44) of fibrous insulation between the roof panels (14) and the insulation strips (36).

13 Claims, 6 Drawing Figures

INSULATED ROOF STRUCTURE

TECHNICAL FIELD

This invention relates generally to roof structures for metal buildings, and more particularly to thermally insulated roof structures for such buildings.

BACKGROUND ART

U.S. Pat. No. 4,044,521 discloses extruded plastic support members each having a hook portion for mounting on a flange portion of a purlin and a planar support portion for holding up an edge portion of a roof liner panel. Fibrous insulation batts may be installed above the panels between the purlins. The system is adapted only for flat or nearly flat roofs and only for new construction, wherein the insulation batts are installed from above as the exterior roof panel installation progresses.

DISCLOSURE OF INVENTION

In accordance with the invention, rollers are suspended on hangers attached to the purlins. The rollers are disposed below the purlins and extend longitudinally thereof. Faced fibrous glass insulation is fed from a roll over the rollers crosswise of the purlins on either flat or pitched roofs and on either new construction or pre-existing building.

BRIEF DESCRIPTION OF DRAWINGS

The invention is described in detail with reference to the accompannying drawings in which.

BEST MODE OF CARRYING OUT THE INVENTION

Figure 1:
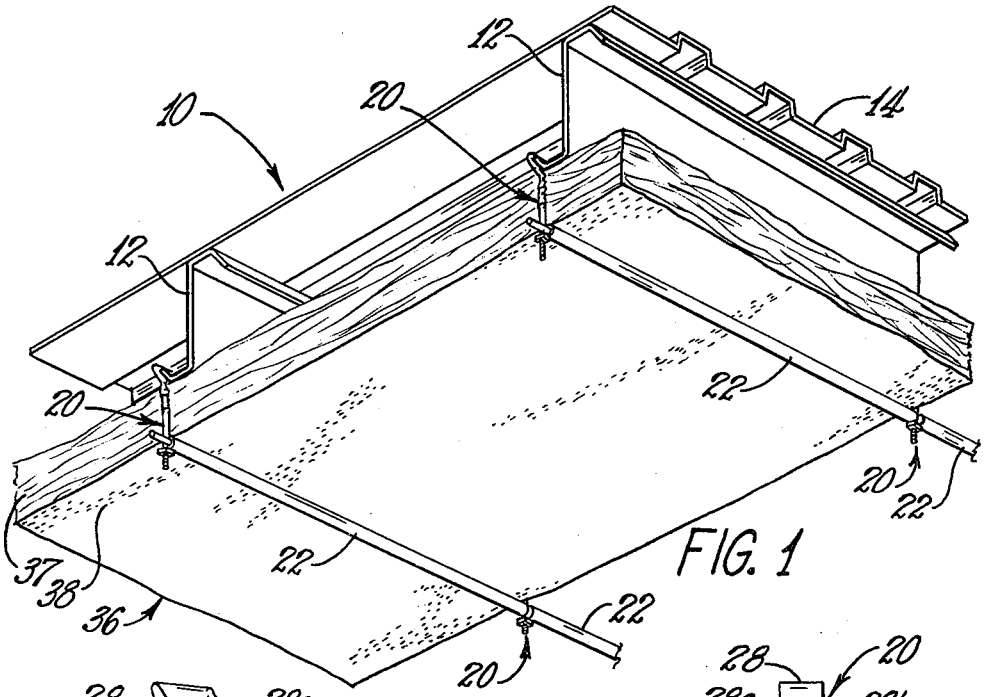
FIG. 1 is a fragmentary perspective view of an insulated roof structure constructed in accordance with the invention.
Figure 3:
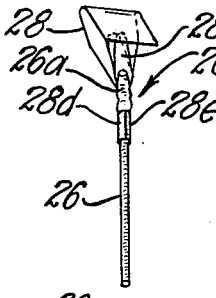
FIG. 3 is a partially exploded elevational view of the hanger assembly of FIGS. 1 and 2 and portions of two rollers.
Figure 3:
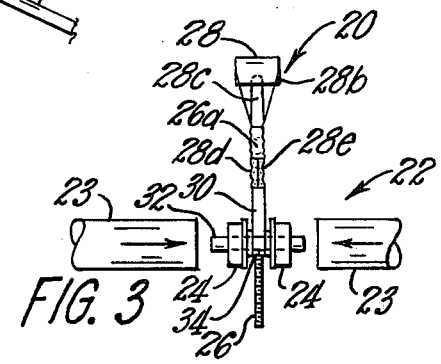
Figure 2:
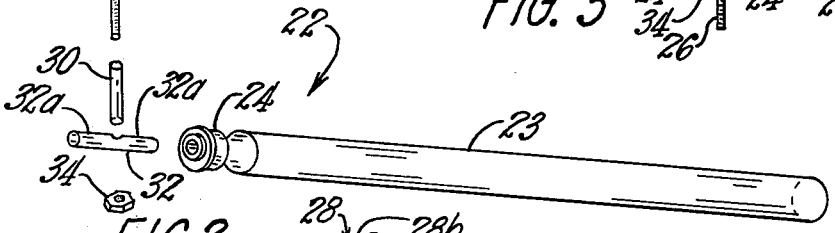
FIG. 2 is an exploded perspective view of a hanger assembly and a roller forming parts of the insulated roof structure of FIG. 1.
Figure 4:
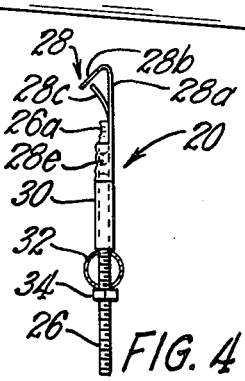
FIG. 4 is a side elevational view of the hanger assembly.

With respect to the drawings, FIG. 1 illustrates an insulated roof structure 10 constructed in accordance with the invention and including a plurality of parallel, spaced, auxiliary support beams or generally Z-shaped purlins 12 covered by a plurality of corrugated metal roof panels 14, only one of which is shown.

Figure 5:
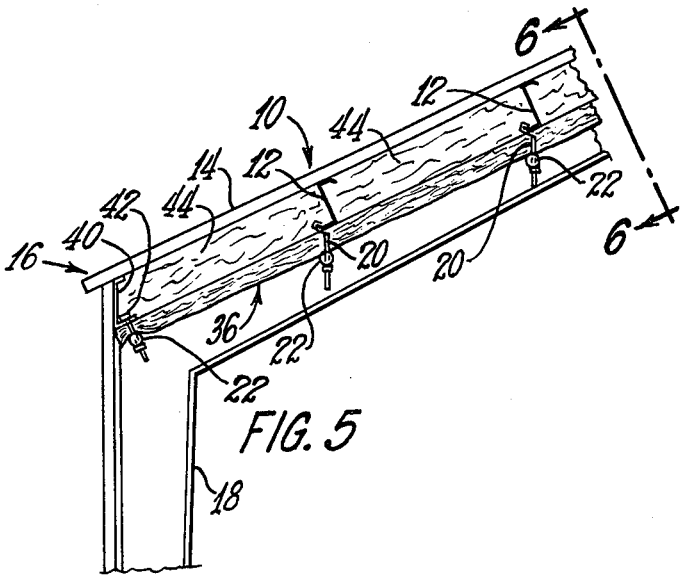
FIG. 5 is a fragmentary transverse sectional view through a metal building having an insulated roof structure constructed in accordance with the invention.

The roof structure 10 may be part of a metal building 16 (FIG. 5). The purlins 12 extend parallel to the length of the building 16 and are supported by a plurality of parallel, spaced, tapered, main support beams or I-beams 18, only one of which is shown.

The insulated roof structure 10 includes a plurality of hanger assemblies 20 for supporting a plurality of elongated support members or rollers 22. Each roller 22 includes a tubular body 23 and a pair of bushings 24 respectively press-fitted into opposite end portions of the tubular body 23. Each of the hanger assemblies 20 includes a threaded rod 26 having a spring clip 28 secured to an upper end portion thereof. The spring clip 28 includes a relatively wide body portion **28*a* having a free end portion 28*b* bent over to form a hook. A resiliently bendable tongue 28*c* is struck out centrally of the body portion 28*a* and disposed in cooperative relationship with the bent-over free end portion 28*b* for clamping a lower flange portion of a purlin 12 therebetween. The body portion 28*a* tapers at its lower end toward the threaded rod 26 and is secured thereto by a pair of tabs 28*d* and 28*e* wrapped therearound and crimped thereto. An upper end portion 26*a* of the threaded rod 26 is flattened out for enlargement in one direction and better retention by the tabs 28*d* and 28*e*. The hanger assembly 20 also includes a spacing sleeve 30 mounted concentrically on the threaded rod 26 in engagement with the tabs 28*d* and 28*e*, an axle tube 32 mounted crosswise on the threaded rod 26 in engagement with the spacing sleeve 30, and a nut 34 threaded on the rod 26 and securing the axle tube 32 against the spacing sleeve 30. However, the spacing tube 30 is optional. Each of the opposite end portions of an axle tube 32 provides a stub axle 32*a* for one of the rollers 22, the bushings 24** being rotatably mounted on the axle tube.

The hanger assemblies 20 are hung from the purlins 12 and the rollers 22 are mounted on the axle tubes 32, the roller tubes 23 extending parallel to the purlins. Insulation strips 36 each including a fibrous glass insulation blanket 37 and a decorative facing 38 are fed from rolls and strung over the roller tubes 23. At each side of the building 16, the lower flange of an eave strut 40 is drilled at properly spaced intervals and rollers 22 are suspended therefrom on bolts 42 inserted through the drilled holes. The bolts 42 are provided respectively with axle tubes 32, but spacing sleeves 30 are omitted therefrom. The roller tubes 23 can thus be tightened against the eave strut 40 to clamp ends of the insulation strips 36. If additional insulation is desired, after each insulation strip 36 is installed, fibrous glass batts 44 of backfill insulation are inserted above the insulation strip 36 and between the purlins 12.

The insulation strips 36 may be furnished in different widths and correspondingly the roller tubes 23 may be furnished in different lengths. Normally several insulation strips 36 are installed beteeen each pair of adjacent beams 18. Opposite end portions of each of the insulation strips 36 are temporarily clamped respectively to the eave struts 40 until all the insulation strips between two adjacent beams 18 are in place. Then the several roller tubes 23 at each eave strut 40 are tightened up against the strut 40 more or less as a unit, and the temporary clamps (not shown) are removed.

Figure 6:
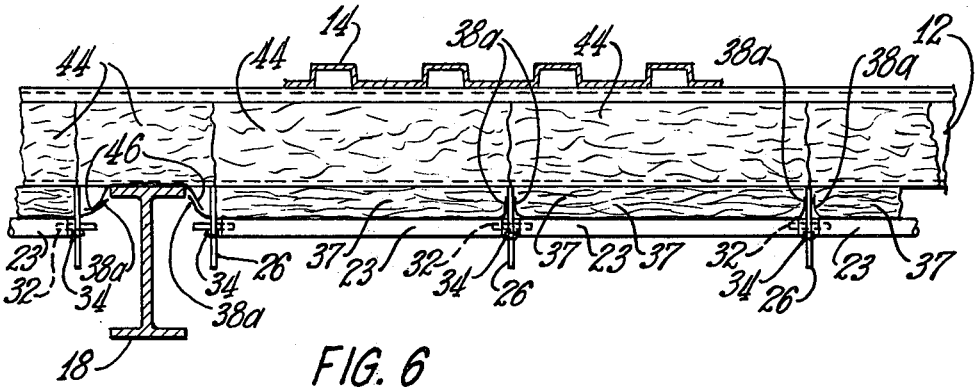
FIG. 6 is a fragmentary sectional view taken generally along the line 6—6 of FIG. 5.

Preferably, the facing 38 is, or includes as a layer thereof, an imperforate plastic film acting as a vapor barrier. Further, insulation strips 36 are normally provided with the facing 38 being wider than the fibrous glass insulation blanket 37 to provide facing edge flaps **38*a* (FIG. 6) respectively on opposite sides of the insulation blanket 37. To provide a continuous vapor barrier, at each joint between two insulation strips 36, the facing edge flaps 38*a* are taped or stapled together and then tucked up between the insulation blankets 37. Further, between each pair of adjacent purlins 12, a separate strip of vapor barrier material 46, preferably the same as the facing 38, is placed over each beam 18 and stapled or taped to facing edge flaps 38*a* of the insulation strips 36 respectively on opposite sides of the beam 18**.

Various modifications may be made in the structure shown and described without departing from the spirit and scope of the invention.

I claim:

1. An insulated roof structure (10) comprising a plurality of parallel, spaced main support beams (18), a plurality of parallel, horizontally extending auxiliary support beams (12) spaced apart from each other and supported by and extending transversely of the main support beams (18), the auxiliary support beams (12) each having a lower upstanding flange, a plurality of roof panels (14) mounted in covering relationship to the auxiliary support beams (12), a plurality of hangers (20) mounted in spaced relationship along each of the auxiliary support beams (12) between each pair of adjacent main support beams (18), each hanger (20) including an upper hook portion (28) in cooperative engagement with the lower upstanding flange of an auxiliary support beam (12), a plurality of elongated support members (22) hung on each of the auxiliary support beams (12) in alignment with each other and parallel to the auxiliary support beams (12), the support members (22) being cooperatively engaged with and suspended by the hangers (20), and insulation strips (36) strung over the support members (22) transversely of the auxiliary support beams (12).

2. An insulated roof structure (10) comprising a plurality of parallel, spaced main support beams (18), a plurality of parallel, horizontally extending auxiliary support beams (12) spaced apart from each other and supported by and extending transversely of the main support beams (18), a plurality of roof panels (14) mounted in covering relationship to the auxiliary support beams (12), a plurality of hanger assemblies (20) mounted in spaced relationship along each of the auxiliary support beams (12) between each pair of adjacent main support beams (18), each hanger assembly (20) including an axle member (32) providing a pair of oppositely extending stub axles (32*a*), a plurality of rollers (22), each roller (22) extending parallel to the auxiliary support beams (12) and having a pair of opposite end portions rotatably mounted respectively on a pair of adjacent stub axles (32*a*) of a pair of adjacent hangers assemblies (20), and a plurality of elongated insulation strips (36) strung over the rollers (22) in covering relationship to the auxiliary support beams (12), each insulation strip (36) extending transversely of the auxiliary support beams (12) over a plurality of rollers (22) hung respectively therefrom.

3. An insulated roof structure (10) as claimed in claim 2 wherein each of the rollers (22) includes a tubular body (23) and a pair of bushings (24) mounted respectively in opposite end portions of the tubular body (23).

4. An insulated roof structure (10) as claimed in claim 2 wherein each of the hanger assemblies (20) includes a threaded rod (26), a spring slip (28) mounted on one end portion of the threaded rod (26), and a nut (34) mounted on the threaded rod (26) from the end thereof opposite the spring clip (28) and retaining the axle member (32) thereon.

5. An insulated roof structure (10) as claimed in claim 4 wherein each of the hanger assemblies (20) includes a spacing sleeve (30) on the threaded rod (26) between the spring clip (28) and the axle member (32).

6. An insulated roof structure (10) as claimed in claim 2 wherein the auxiliary support beams (12) are generally Z-shaped in cross-section.

7. An insulated roof structure (10) as claimed in claim 2 including a plurality of batts (44) of fibrous insulation, the batts (44) being installed above the insulation strips (36) between pairs of adjacent auxiliary support beams (12).

8. An insulated roof structure (10) as claimed in claim 2 wherein each of the insulation strips (36) includes a fibrous glass insulation blanket (37).

9. An insulated roof structure (10) as claimed in claim 8 wherein each of the insulation strips (36) includes a decorative facing (38).

10. An insulated roof structure (10) as claimed in claim 9 wherein the decorative facing (38) is wider than the fibrous glass insulation blanket (37) to provide a pair of opposite edge flaps (38*a*) respectively on opposite sides of the fibrous glass insulation blanket (37).

11. A hanger assembly (20) for rotatably supporting one end position of each of two rollers (22) below a beam (12) of a roof structure, the beam (12) having a lower upstanding flange, the hanger assembly (20) comprising a rod (26), a spring clip (28) mounted on an upper end portion of the rod (26) and adapted to hook over the upstanding lower flange of the beam (12), and an axle member (32) mounted on the rod (26) below the spring clip (28) and providing a pair of oppositely and horizontally extending stub axles (32*a*) for respectively rotatably supporting the rollers (22) when the hanger assembly (20) is mounted on the beam (12).

12. A hanger assembly (20) as claimed in claim 11 wherein the rod (26) is threaded and the axle member (32) is a cross-drilled tube held on the rod (26) by a nut (34).

13. A hanger assembly (20) as claimed in claim 12 including a spacing sleeve (30) on the threaded rod (26) between the spring clip (28) and the axle member (32).

* * * * *